United States Patent [19]

Van Egmond

[11] Patent Number: 5,065,818

[45] Date of Patent: Nov. 19, 1991

[54] SUBTERRANEAN HEATERS

[75] Inventor: Cornelis F. H. Van Egmond, Houston, Tex.

[73] Assignee: Shell Oil Company, Houston, Tex.

[21] Appl. No.: 637,859

[22] Filed: Jan. 7, 1991

[51] Int. Cl.[5] ..... E21B 36/04

[52] U.S. Cl. ..... 166/60; 219/415; 219/417

[58] Field of Search ..... 166/248, 302, 385, 57, 166/60, 65.1; 219/415, 417

[56] References Cited

U.S. PATENT DOCUMENTS

| | | | |
|---|---|---|---|
| 2,500,513 | 3/1950 | Bowman | 166/17 |
| 2,732,195 | 1/1956 | Ljungstrom | 262/3 |
| 2,781,851 | 2/1957 | Smith | 166/60 |
| 2,893,490 | 7/1959 | Williams et al. | 166/60 |
| 3,104,705 | 9/1963 | Ortloff et al. | 166/39 |
| 3,114,417 | 12/1963 | McCarthy | 166/60 |
| 3,131,763 | 5/1964 | Kunetka et al. | 166/60 |
| 3,207,220 | 9/1965 | Williams | 166/60 |
| 3,522,847 | 8/1970 | New | 166/60 |
| 4,415,034 | 11/1983 | Bouck | 166/302 |
| 4,440,219 | 4/1984 | Engelder | 166/57 |
| 4,570,715 | 2/1986 | Van Meurs et al. | 166/302 |
| 4,572,299 | 2/1986 | Vanegmond et al. | 166/60 X |
| 4,616,705 | 10/1986 | Stegemeier et al. | 166/250 |
| 4,704,514 | 11/1987 | Van Egmond et al. | 219/278 |
| 4,951,748 | 8/1990 | Gill et al. | 166/60 X |

FOREIGN PATENT DOCUMENTS

| | | | |
|---|---|---|---|
| 659729 | 4/1979 | U.S.S.R. | 166/60 |

*Primary Examiner*—William P. Neuder

[57] ABSTRACT

An electrical resistance subterranean heater is provided which is cemented directly in a well borehole without a casing in the borehole within the zone to be heated. The absence of the casing results in an economical installation.

10 Claims, 2 Drawing Sheets

SUBTERRANEAN HEATERS

FIELD OF THE INVENTION

This invention relates to improved subterranean electrical resistance heaters.

BACKGROUND OF THE INVENTION

Electrical resistance heaters suitable for heating subterranean earth formations have been under development for many years. These heaters have been found to be useful for carbonizing hydrocarbon-containing zones for use as electrodes within reservoir formations, for enhanced oil recovery and for recovery of hydrocarbons from oil shales. U.S. Pat. No. 2,732,195 discloses a process to create electrodes utilizing a subterranean heater. The heater utilized is capable of heating an interval of 20 to 30 meters within subterranean oil shales to temperatures of 500° C. to 1000° C. Iron or chromium alloy resistors are utilized as the core heating element. These heating elements have a high resistance and relatively large voltage is required for the heater to extend over a long interval with a reasonable heat flux.

Subterranean heaters having copper core heating elements are disclosed in U.S. Pat. No. 4,570,715. This core has a low resistance, which permits heating long intervals of subterranean earth with a reasonable voltage across the elements. Because copper is a malleable material, this heater is much more economical to fabricate than iron or chromium alloy cored heaters. These heaters can heat 1000-foot intervals of earth formations to temperatures of 600° C. to 1000° C. with 100 to 200 watts per foot of heating capacity with a 1200 volt power source. They could therefore be useful in thermal recovery of hydrocarbons from heavy oil reservoirs and from oil shales.

The capital investment required to utilize these heaters to recover hydrocarbon from subterranean formations generally renders the use of such heaters economically unviable. These heaters each require casings within the well borehole to protect the heaters. The casings themselves must be capable of withstanding 600° to 1000° C. temperatures in corrosive environments. The heaters are suspended within the casings in a gas environment. The casing therefore does not have a significant hydrostatic head on the inside. The casing is therefore generally exposed to high crushing forces. High crushing forces dictate that the casing be of significant thickness. Casings for wells utilizing these heaters therefore represent a major investment.

It is therefore an object of the present invention to provide a subterranean heater which does not require a casing.

It is another object to provide a subterranean heater which can provide from about 100 to about 200 watts of heat per foot of heater length for a 20-year or more useful life.

In another aspect, it is an object of the present invention to provide a process to heat subterranean formations which do not require casings in heat injection wells.

SUMMARY OF THE INVENTION

The objects of this invention are achieved by providing a subterranean heater within a well borehole in a formation to be heated, the heater comprising: at least one electrically resistive core; mineral insulation surrounding the core; a sheath surrounding the mineral insulation; cement securing the sheath in the well borehole wherein a casing is not present within the well borehole in the formation to be heated; and a means to supply electrical power through the electrically resistant core.

These heaters are particularly useful in enhanced recovery of heavy oils from oil bearing strata, and in recovery of hydrocarbons from oil shales. The installation of this heater can be economically viable at energy costs much lower than prior art heaters due to savings from elimination of the casing. The heater may be a spoolable heater prior to cementing into the formation and still have sufficient sheath thickness to retain a corrosion allowance which permits a twenty year or greater useful life.

Cementing the thermowell and heater into the borehole, and eliminating at least this portion of the casing, reduces the expense of the installation considerably. If a casing is used, it must be fabricated from expensive materials due to the high temperature and corrosive environment. Heat transfer is also improved when the casing is eliminated due to the absence of the gas space around the heater. A smaller diameter well hole can also be utilized. The smaller diameter hole may result in less cement being required to cement the heating cables than what would be required to cement a casing into a borehole. The smaller borehole also reduces drilling costs. The problems involved with hermetically sealing the casing to exclude liquids from entering are also avoided by elimination of the casing. Cementing the heating cables directly into the borehole also eliminates thermal expansion and creep by securing the heating cables into their initial positions.

DETAILED DESCRIPTION OF THE INVENTION

A preferred basic heater design for the practice of this invention is described in U.S. Pat. No. 4,570,715, incorporated herein by reference. The well heaters may be of other designs so long as the installation of such heater is without a casing, and sheathing of the heater is with a material and thickness of the material which provides a corrosion allowance for a 20 year useful life.

The electrically resistive core of this heater is preferably one of relatively low electrical resistance, such as copper or LOHM. Having this relatively low electrical resistance permits heating long intervals with reasonably low power supply voltages. LOHM, an alloy of about 94 percent by weight copper and 6 percent by weight of nickel is particularly preferred because it has a very low temperature coefficient of resistance. This significantly reduces the tendency for the heater core to form hot spots within formation regions which have locally low heat transfer coefficients.

The heater core and metal sheath are separated by a packing of mineral insulation material. Preferred mineral insulation materials include magnesium oxides.

The uphole ends of the sheathed heating element cables are preferably connected to power supply cables. Power supply cables are heat-stable similarly insulated and sheathed cables containing cores having ratios of cross-sectional area to resistance making them capable of transmitting the electrical current flowing through the heating elements while generating heat at a significantly lower rate. The power supply cables are metal sheathed, mineral insulated, and copper cored, and have cross-sectional areas large enough to generate only an insignificant amount of heat while supplying all of the current needed to generate the selected temperature in the heated zone. The metal sheaths preferably are copper.

Splices of the cores in cables in which mineral insulation and a metal sheath encase current-conducting cores are preferably surrounded by relatively short lengths of metal sleeves enclosing the portions in which the cable cores are welded together or otherwise electrically interconnected. Such electrical connections should provide joint resistance at least as low as that of the least electrically resistive cable core being joined. Also, an insulation of particulate material having properties of electrical resistivity, compressive strength, and heat conductance at least substantially equalling those of the cable insulations, is preferably compacted around the cores which are spliced.

Figure 1:
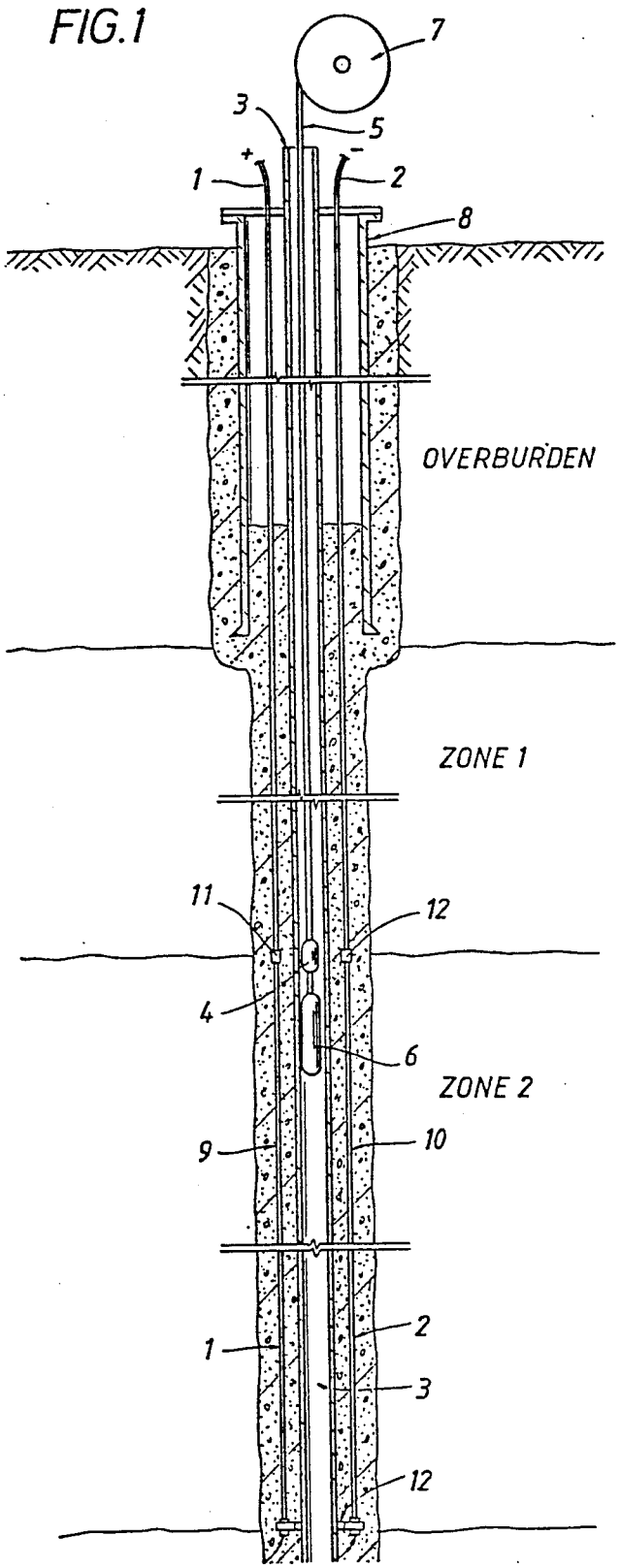
FIG. 1 is a schematic illustration of a heater of the present invention installed within a well.

FIG. 1 shows a well, 1, which extends through a layer of "overburden" and zones 1 and 2 of an earth formation. Zone 2 is a zone which is to be heated.

As seen from the top down, the heater assembly consists of a pair of spoolable electric power supply cables 1 and 2, an optional thermowell 3. A thermocouple, 4, is suspended by a thermocouple wire 5, and held taut by a sinker bar, 6. The thermocouple may be raised or lowered by rotating a spool, 7. The heating cables are cemented directly in place, as shown in FIG. 1. The casing does not extend to the zone which the heater is to heat. At the interface of the zone which is to be heated, zone 2, and the zone which is not to be heated, zone 1, power supply cables, 1 and 2, are spliced to heater cables, 9 and 10, through splices, 11 and 12. The heating cables extend downward to the bottom of the zone to be heated. At the bottom of the heating cables the heater cores are grounded to the cable sheaths with termination plugs, 13. The termination plugs may be electrically connected by a means such as the coupler, 12.

Figure 2:
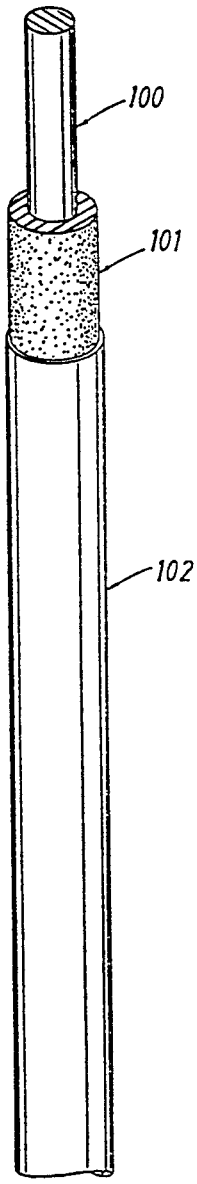
FIG. 2 is a three-dimensional illustration of an insulated and sheathed heating element of the present invention.

FIG. 2 shows a preferred structural arrangement of the heating and power supply cables. Referring to FIG. 2, an electrically conductive core, 100, is surrounded by an annular mass of compressed mineral insulating material, 101, which is surrounded by a metal sheath, 102. The metal sheath may optionally be fabricated in two layers (not shown). A relatively thin inner layer may be fabricated initially, and a thicker outer layer of a material resistant to corrosion could then be added in a separate step.

Figure 3:
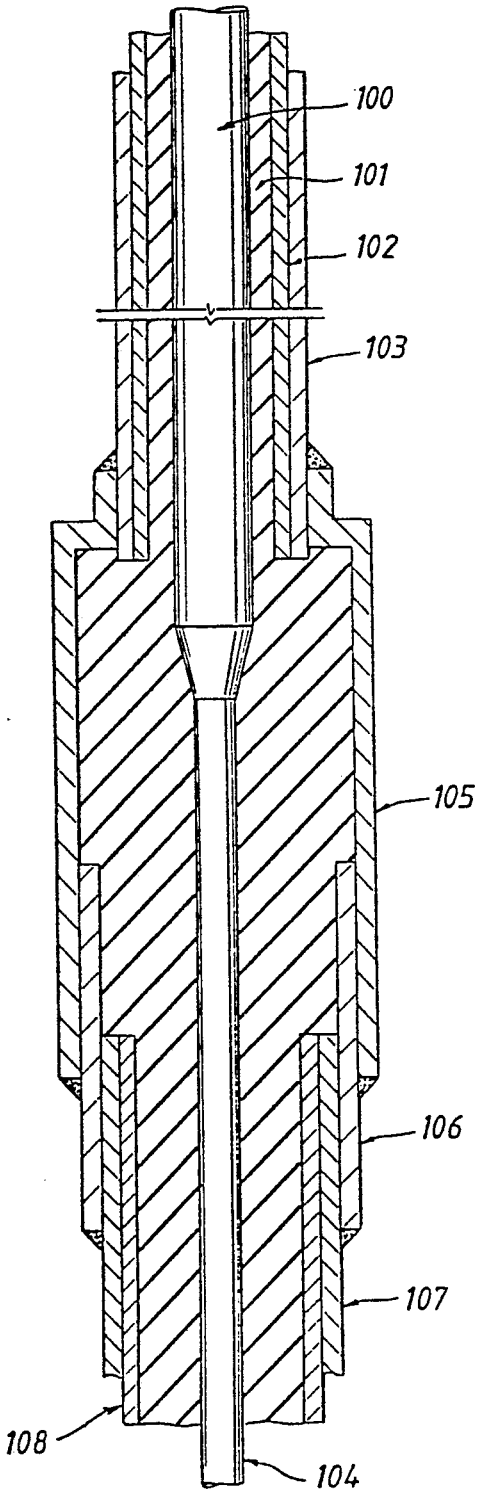
FIG. 3 is a cross-sectional illustration of the power cable to heating cable splice of the present invention.

FIG. 3 displays details of the splice 9, of FIG. 1. The power supply cable consisting of the electrical conductive core, 100, is surrounded by compressed mineral insulation, 101, covered by a sheath, 102. The electrical conductive core of the power supply cable is preferably copper and is of a sufficiently large cross-sectional area to prevent a significant amount of heat from being generated under operating conditions. The sheath of the power supply cable is preferably copper.

The diameter of the electrically conductive core within the cable can be varied to allow different amounts of current to be carried while generating significant or insignificant amounts of heat, depending upon whether the conductive core is a heating cable or a power supply cable.

A transition sheath, 103, extends up from the coupled end of the power supply cable in order to protect the sheath from corrosion due to the elevated temperature near the heating cable. This protective sheath is preferably the same material as the sheathing material of the heating cable. The protective sheathing could extend for a distance of between a few feet to over 40 feet. A distance of about 40 feet is preferred due to the possibility of water vapor condensing on the power supply cable in this region. This distance ensures that the power supply cable will not be damaged as a result of exposure to high temperatures in the vicinity of the heating cables.

In FIG. 3, the heating cable sheath is shown as the preferred two-layer sheath of an inner sheath, 108, and an outer sheath, 107. The core of the heating cable, 104, is welded to the power supply cable core, 100. The heating cable is of a cross section area and resistance such as to create from 50 to 250 watts per foot of heat at operating currents. The coupling sleeve, 105, and compression sleeve, 106, are slid onto either the power supply cable or heating cable prior to the cores of the cables being welded. After the cores are welded together, the coupling sleeve, 105, is welded into place onto the power supply cable. The space around the power supply cable core to heating cable core is then filled with a mineral insulating material. The mineral insulating material is then compressed by sliding the compression sleeve, 106, into the space between the sleeve coupling and the heating cable. After the compression sleeve is forced into this space, it is sealed by welded connections to the heating cable outer sheath, 107, and the coupling sleeve.

For use in the present invention, the diameter and thickness of the sheath is preferably small enough to provide a cable which is "spoolable", i.e., can be readily coiled and uncoiled from spools without crimping the sheath or redistributing the insulating material.

A double layer sheath is preferred. The inner layer and the outer layer are both preferably an INCOLOY alloy and INCOLOY 800 ® is most preferred. A total sheath thickness of about one-quarter inch is preferred although a thickness of from one-eighth inch to one-half inch can be acceptable depending upon the service time desired, operating temperatures, and the corrosiveness of the operating environment.

FIG. 3 displays a one core element, but it is most preferred that the cable be fabricated with two or three cores. The multiple cores can each carry electricity, and eliminate the need for parallel heating and power supply cables. A single-phase alternating current power supply requires two cores per cable and a three-phase alternating power supply requires three cores per cable.

Figure 4:
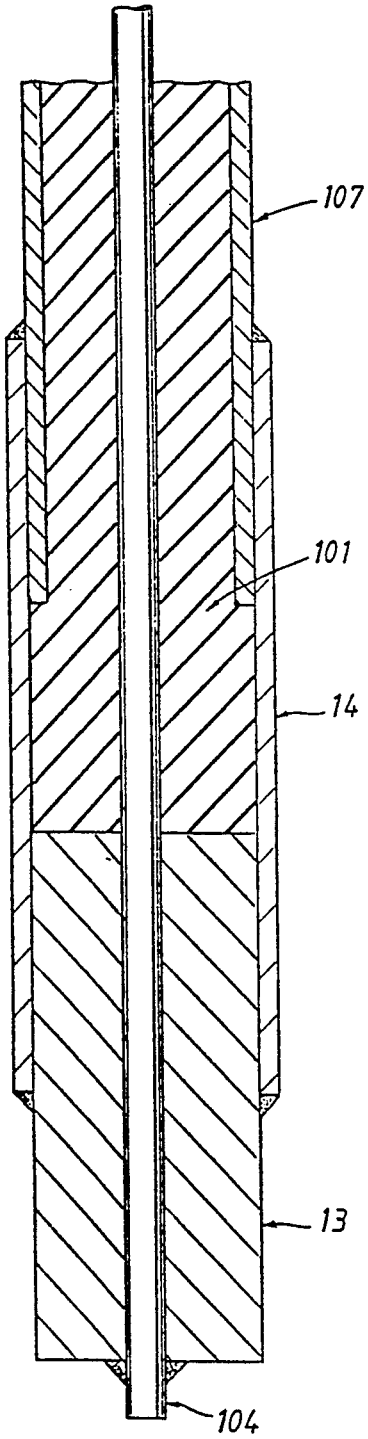
FIG. 4 is a cross-sectional illustration of the heating cable bottom terminal plug.

The heating cable cores are preferably grounded at the downhole extremity of the heating cable opposite the end of the heating cable which is coupled to the power supply cables. FIG. 1 includes the preferred termination plugs, 13, connected by an electrically conductive end coupler, 12. FIG. 4 displays the preferred termination plug. The plug, 13, is forced into a termination sleeve, 19, which had been previously welded onto the sheath of the power supply cable, 107. The termination plug is forced into the sleeve to compress the mineral insulating material, 101. The termination plug is then brazed onto the heating cable core, 104, and welded to the termination sleeve. The termination plugs on each heating cable may be clamped together, as shown in FIG. 1. When a heating cable with multiple cores is utilized, the termination plug has a hole for each, and the plug serves to electrically connect the cores.

Electrical energy is preferably provided to the heating cables by zero crossover firing. Zero crossover electrical heater firing control is achieved by allowing full supply voltage to pass through the heating cable for a specific number of cycles, starting at the "crossover", where instantaneous voltage is zero, and continuing for a specific number of complete cycles, discontinuing when the instantaneous voltage again crosses zero. A specific number of cycles are then blocked, allowing control of the heat output by the heating cable. The system may be arranged to "block" 15 or 20 cycles out of each 60. This control is not practical when the core material is not LOHM, or another material which has a low temperature coefficient of resistance. A resistance which varies significantly with temperature would cause the current required to vary excessively.

The alternative firing control which is required when copper core heaters are utilized is phase angle firing. Phase angle firing passes a portion of each power cycle to the heater core. The power is applied with a non-zero voltage and continues until the voltage passes to zero. Because voltage is applied to the system starting with a voltage differential, a considerable spike of amperage occurs, which the system must be designed to tolerate. The zero crossover power control is therefore generally preferred.

A thermowell may be incorporated into a well borehole which incorporates the heater of the present invention. The thermowell may be incorporated into a well without a casing. The thermowell must be of a metallurgy and thickness to withstand corrosion by the subterranean environment. A thermowell and temperature logging process such as that disclosed in U.S. Pat. No. 4,616,705 is preferred. Due to the expense of providing a thermowell and temperature sensing facilities, it is envisioned that only a small number of thermowells would be provided in heating wells within a formation to be heated.

Subterranean earth formations which contain varying thermal conductivities may require segmented heating cables, with heat outputs per foot adjusted to provide a more nearly constant well heater temperature profile. Such a segmented heater is described in U.S. Pat. No. 9,570,715. The greatly reduced tendency of LOHM core well heaters to develop hot spots greatly reduces the need for the well heater core to have a heat output which is correlated with local variations in subterranean thermal conductivities, but the technique of segmenting the heater coil may be beneficial, and required to reach maximum heat inputs into specific formations.

I claim:

1. A subterranean heater with a well borehole in a formation to be heated, the heater comprising:

a) at least one electrically resistive core;

b) mineral insulation surrounding the core;

c) a sheath surrounding the mineral insulation;

d) cement securing the sheath in the well borehole, wherein a casing is not present within the well borehole in the formation to be heated; and e) a means to supply electrical power through the electrically resistive core.

2. The heater of claim 1 wherein the sheath comprises an inner sheath and an outer sheath.

3. The heater of claim 1 wherein the sheath comprises INCOLOY 800.

4. The heater of claim 1 wherein the sheath is of a thickness of between about 0.125 and about 0.5 inches.

5. The heater of claim 1 wherein the heater comprises two electrically resistive cores within the sheath, separated by the mineral insulation.

6. The heater of claim 1 wherein the heater comprises three electrically resistive cores within the sheath separated by the mineral insulation.

7. The heater of claim 1 wherein the heater is capable of heating intervals of a subterranean formation up to 1000 feet long.

8. The heater of claim 1 wherein the heater is capable of an average useful life in excess of 20 years.

9. The heater of claim 1 wherein the heater is capable of supplying heat into the formation in an amount of from about 50 to about 250 watts per foot of heater length.

10. The heater of claim 1 wherein the heater is, prior to being cemented into the well borehole, a spoolable heater cable.

* * * * *